United States Patent [19]

Fraser

[11] Patent Number: 4,725,198

[45] Date of Patent: Feb. 16, 1988

[54] GAS CIRCULATOR

[75] Inventor: William M. Fraser, Barrhead, Scotland

[73] Assignee: James Howden & Company Limited, Glasgow, Scotland

[21] Appl. No.: 877,841

[22] Filed: Jun. 24, 1986

[30] Foreign Application Priority Data

Jul. 9, 1985 [EP] European Pat. Off. ..... 85304897

[51] Int. Cl.[4] ..... F04D 29/04

[52] U.S. Cl. ..... 415/110; 415/170 A; 417/423 R; 310/90; 310/90.5

[58] Field of Search ..... 415/110, 111, 170 R, 415/175, 170 A, 90, 112, 113; 310/90, 90.5; 417/423 P, 423 S

[56] References Cited

U.S. PATENT DOCUMENTS

| | | | |
|---|---|---|---|
| 2,799,227 | 7/1957 | Allen | 415/104 |
| 3,694,110 | 9/1972 | Guinard | 415/111 |
| 3,764,236 | 10/1973 | Carter | 415/104 |
| 3,850,550 | 11/1974 | Kaessen | 415/111 |
| 4,579,508 | 4/1986 | Tsumaki et al. | 415/90 |

FOREIGN PATENT DOCUMENTS

| | | |
|---|---|---|
| 2251176 | 4/1974 | Fed. Rep. of Germany . |
| 1304989 | 4/1971 | United Kingdom . |
| 1454205 | 7/1974 | United Kingdom . |
| 2121479 | 12/1985 | United Kingdom . |

*Primary Examiner*—Robert E. Garrett
*Assistant Examiner*—John T. Kwon
*Attorney, Agent, or Firm*—Barnes & Thornburg

[57] ABSTRACT

A gas circulator, e.g. for circulating a coolant gas in a nuclear power station, the circulator comprising a shaft (34) rotatable about its axis, circulation blades (54, 56) mounted adjacent one end of the shaft for rotation in the coolant gas, a first bearing, (32), in the form of an active magnetic bearing adjacent one end of the shaft, a seal mounted around the shaft between the first bearing and the blades to prevent the circulating fluid from entering the first bearing, a second bearing (32) in the form of a fluid lubricated bearing spaced from one end of the shaft and a motor to rotate the shaft, the second bearing having a journal bearing portion and an axial thrust bearing portion.

2 Claims, 1 Drawing Figure

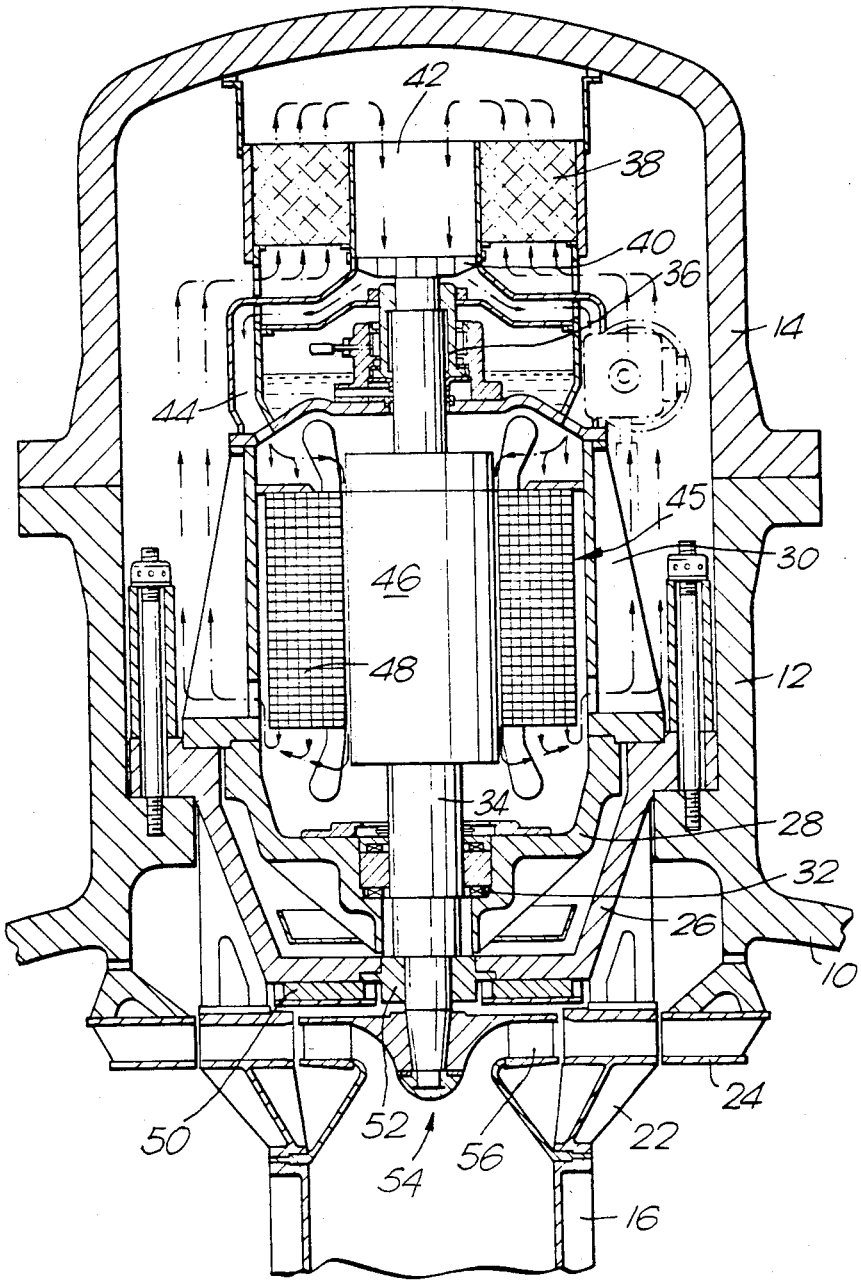
42
38
40
36
14
44
45
30
46
48
12
34
28
32
26
10
24
50
52
54
56
22
16

GAS CIRCULATOR

BACKGROUND OF THE INVENTION

The present invention relates to fluid circulators.

In nuclear power reactors, gas, usually, helium, is circulated from the nuclear power reactor, to take up heat from the reactor and transport it to steam generators. Established practice is to use electrically driven circulators, in which the driving motor and the support bearings are submerged in high pressure gas, which is in direct communication with the gas circuit.

The electrically driven generators have conventionally used oil lubricated gearings, one of which, of necessity, is located close to the reactor gas circuit and therefore has the potential to leak oil into this gas circuit. By careful seal design it is possible to minimize this leakage, but unfortunately it cannot be reduced to absolute zero.

A further proposal has been to use active magnetic bearings for rotor support. This would involve no lubricating fluid and therefore there will be no possibility to contaminate the reactor gas circuit. However, there are two main disadvantages which have to be weighed against this advantage. Firstly, should the magnetic bearing system be subject to a failure, for example a power failure, the machine has to be capable of coming safely to rest. It is common practice for the circulator to operate at speeds of the order of 6,000 rpm and, the requirement for safety necessitates the provision of short life auxiliary or socalled 'catcher' bearings. In a high speed machine, with a large aerodynamic thrust, this provision is technically very difficult to achieve especially when the gas which is being circulated is dry helium. Secondly, the combined thrust and journal bearing necessary at at least one end of the circulator, requires a large number of power and shaft position monitoring signal leads to be physically brought out of the high pressure environment. It is difficult to achieve and maintain supply and signal integrity and the leads can become a source of unreliablity.

SUMMARY OF THE INVENTION

It is now proposed, according to the present invention, to provide a fluid circulator comprising a shaft rotatably about its axis, circulation blades mounted adjacent one end of the shaft, a first bearing for said shaft adjacent said one end, a second bearing spaced from said one end and means to rotate the shaft about its axis, the first bearing being an active magnetic bearing and the second bearing being a fluid lubricated bearing including a radial bearing portion and an axial thrust bearing portion.

It will be appreciated that by having the active magnetic bearing adjacent the circulator blades, there will be no possibility of any oil leaking into the gas coolant system. Furthermore, by providing a fluid lubricating bearing, including a radial bearing portion and an axial thrust bearing portion, at the far end of the shaft from the circulator blades, should there be a power failure, the circulator can operate perfectly satisfactorily for a sufficient time for the circulator to run down from full speed. The radial or journal bearing portion will keep the shaft centralized and the thrust bearing portion will fully carry the load of the shaft even if this shaft is, as is customary, mounted to rotate about a vertical axis.

While such a machine still requires careful design to reduce any risk of oil leakage from the second bearing, it only requires a simple auxiliary first bearing at the reactor end; the magnitude of this combination of design problems is considerably less than the magnitude of the problems associated with either of the alternatives, i.e. a wholly fluid lubricated or a wholly active magnetic bearing.

BRIEF DESCRIPTION OF THE DRAWING

In order that the invention may more readily be understood, the following description is given, merely by way of example, reference being made to the accompanying drawing, in which the sole Figure is a schematic crosssection through one embodiment of circulator according to the present invention.

DETAILED DESCRIPTION OF A PREFERRED EMBODIMENT

In the drawing, there is illustrated a main vessel 10 having mounted thereon a lower circulator housing 12 above which is mounted an upper circulator housing 14.

Within the main vessel 10 there is a vertically extending inlet tube 16 connected to an inner diffuser 22 and an outer diffuser with guide vanes 24.

Mounted in the lower part of the lower circulator housing 12 is a lower pressure casing 26 within which is mounted a lower frame 28. This supports an upper frame 30.

Mounted within the lower frame 28 is a first bearing 32 in the form of an active magnetic bearing, in which is mounted the lower part of a vertical axis shaft 34, the upper part is mounted within a second bearing 36 carried by the upper frame 30.

Above the upper frame 30 is a gas cooler 38 and mounted immediately below this and on the shaft 34 is a cooler impeller 40 which draws a collant gas, preferably helium, over the cooler, and through an inlet 42 from which it is projected by the impeller through outlets 44 to cool a motor 45 which inlcudes an armature 46 and field windings 48.

Surrounding the lower part of the shaft 34, below the first bearing 32, is a thermal insulating shield 40 and above this is provided a labyrinth seal 52 surrounding the shaft to prevent any oil which may be in the atmosphere around the shaft from entering into the main vessel 10. A main impeller 54 having blades 56 is carried by the lower end of the shaft.

Rotation of the armature 46 and thus of the shaft 34 causes rotation of the impeller 54 so that gas is drawn in through the inlet tube 16 and is projected outwardly via the diffuser and guide vanes 22,24. Thus the helium gas within the main vessel 10 can be circulated by the circulator impeller 54,56.

By providing the first bearing 32 of the active magnetic type there will be substantially no oil appearing in the vicinity of the impeller and so there will be substantially no oil at all entering the main vessel 10.

At the same time, by providing a conventional oil lubricated bearing 36 which acts both as a journal bearing and a thrust bearing, should there be any power failure which would reduce significantly the effectiveness of the magnetic bearing 32 substantially to zero, the shaft 34 can continue to rotate and be held up without causing any damage while the motor armature 46 runs down. Obviously this situation cannot carry on indefinitely, but the arrangement of having a oil lubricating bearing remote from the impeller and an active magnetic bearing adjacent the impeller overcomes the disadvantages of the prior known assembly.

While the shaft 34 has been shown with its axis vertical, it could be horizontal, or at an angle, and equally could be vertical with the impeller at the upper end.

I claim:

1. A fluid circulator comprising a circulator housing, a shaft rotatable about its axis, circulator blades mounted adjacent one end of the shaft, a fluid inlet and a fluid outlet formed in said housing adjacent said circulator blades, whereby rotation of said shaft causes fluid to flow from said inlet to said outlet, a first bearing mounted in said housing for rotatably supporting said shaft adjacent said one end of said shaft, said first bearing being an active magnetic bearing, a seal mounted around said shaft between said first bearing and said blades to prevent the circulated fluid from entering said first bearing, a second bearing mounted in said housing at a location spaced from said one end, said second bearing being a fluid lubricated bearing including a journal bearing portion and a thrust bearing portion, and means to rotate said shaft about its axis.

2. A gas circulator for circulating a coolant gas in a nuclear power reactor, said circulator comprising a circulator housing, a shaft rotatable about its axis, circulator blades mounted adjacent one end of the shaft, a coolant gas inlet and a coolant gas outlet formed in said housing adjacent said circulator blades, whereby rotation of said shaft causes rotation of said blades in the coolant gas, thereby to cause said coolant gas to flow from the inlet to the outlet, a first bearing mounted in said housing for rotatably supporting said shaft adjacent said one end, said first bearing being an active magnetic bearing, a seal mounted around said shaft between said first bearing and said blades to prevent the circulated coolant gas from entering said first bearing, a second bearing spaced from said one end and being a fluid lubricated bearing including a journal bearing portion and a thrust bearing portion, and means to rotate said shaft about its axis.

* * * * *

UNITED STATES PATENT AND TRADEMARK OFFICE

CERTIFICATE OF CORRECTION

PATENT NO. : 4,725,198

DATED : February 16, 1988

INVENTOR(S) : William M. Fraser

It is certified that error appears in the above-identified patent and that said Letters Patent is hereby corrected as shown below:

At column 1, line 14, please delete "gearings" and insert therefor --bearings--;

At column 1, line 45, please delete "rotatably" and insert therefor --rotatable--;

At column 2, line 35, please delete "collant" and insert therefor --coolant--;

At column 2, line 38, please delete "inlcudes" and insert therefor --includes--;

At column 2, line 41, please delete "40" and insert therefor --50--; and

Signed and Sealed this

Ninth Day of August, 1988

*Attest:*

*Attesting Officer*

DONALD J. QUIGG

*Commissioner of Patents and Trademarks*